US008057260B2

(12) United States Patent
Zhu et al.

(10) Patent No.: US 8,057,260 B2
(45) Date of Patent: Nov. 15, 2011

(54) CABLE ASSEMBLY HAVING IMPROVED INSULATIVE HOLDING DEVICE AND METHOD FOR MAKING THE SAME

(75) Inventors: Qing-Man Zhu, Kunshan (CN); Xue-Liang Zhang, Kunshan (CN); Chien-Chiung Wang, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/849,056

(22) Filed: Aug. 3, 2010

(65) Prior Publication Data

US 2011/0034082 A1 Feb. 10, 2011

(30) Foreign Application Priority Data

Aug. 4, 2009 (CN) ..... 2009 2 0307320.6

(51) Int. Cl.
*H01R 9/03* (2006.01)

(52) U.S. Cl. ..... 439/607.41; 439/607.46

(58) Field of Classification Search ..... 439/607.41, 439/607.42, 607.44, 607.46, 607.47, 607.55, 439/98, 470
See application file for complete search history.

(56) References Cited

U.S. PATENT DOCUMENTS

| | | | | |
|---|---|---|---|---|
| 6,336,827 | B1 * | 1/2002 | Akama et al. | 439/607.46 |
| 6,887,091 | B1 * | 5/2005 | Wu | 439/352 |
| 7,097,527 | B2 | 8/2006 | Hanley et al. | |
| 7,297,028 | B2 * | 11/2007 | Daikuhara et al. | 439/607.46 |
| 7,651,375 | B2 * | 1/2010 | Zhu et al. | 439/607.41 |
| 7,771,225 | B1 * | 8/2010 | Wu | 439/352 |
| 7,841,887 | B2 * | 11/2010 | Zhang et al. | 439/352 |
| 7,909,632 | B2 * | 3/2011 | Wu | 439/353 |
| 2002/0086583 | A1 * | 7/2002 | Casey | 439/610 |
| 2009/0156059 | A1 * | 6/2009 | Zhu et al. | 439/607.41 |
| 2009/0274468 | A1 * | 11/2009 | Zhang et al. | 398/139 |

FOREIGN PATENT DOCUMENTS

CN 201178199 1/2009

* cited by examiner

*Primary Examiner* — Hae Moon Hyeon
(74) *Attorney, Agent, or Firm* — Ming Chieh Chang; Wei Te Chung; Andrew C. Cheng

(57) ABSTRACT

A cable assembly (100) includes an interior printed circuit board (13) with a number of conductive pads (132), a cable (2) and an insulative holding device (25). The cable (2) includes a number of conductors (21), a conductive sheath (22) shrouding the conductors (21) and an insulative sheath (23) shrouding the conductive sheath (22). Each conductor (22) has a soldering tail (24) extending to the outside of the insulative sheath (23) and soldering to the conductive pad (132). The insulative holding device (25) encloses the insulative sheath (22) and the conductors (21).

2 Claims, 4 Drawing Sheets

CABLE ASSEMBLY HAVING IMPROVED INSULATIVE HOLDING DEVICE AND METHOD FOR MAKING THE SAME

BACKGROUND OF THE INVENTION

1. Field of the Invention

The present invention relates to a cable assembly having an improved cable holding device adapted for fastening the cable and a method for producing the same.

2. Description of Related Art

U.S. Pat. No. 7,090,527 issued on Aug. 15, 2006 discloses a SFP (Small Form Factor Pluggable) module. The SFP module comprises a cable having a number of conductive cores, a top shell, a bottom shell and an interior PCB (printed circuit board). A metal ring is attached to one end of the cable. The conductive cores of the cable extend outside of the metal ring for soldering on the interior PCB. One side of the bottom shell defines a cavity for receiving the interior PCB. Another side of the bottom shell defines a slot receiving the metal ring. The top shell covers on the bottom shell to hold the interior PCB and cable stably.

The conductive cores of the cable are not fixed in any predetermined position and thereby are hard to be soldered on the PCB.

C.N. Patent No. 201178199 issued on Jan. 7, 2009 discloses a SFP (Small Form Factor Pluggable) module. The SFP module comprises a cable, a top shell, a bottom shell and an interior PCB. A metal ring is attached to one end of the cable. The conductive cores of the cable extend outside of the metal ring. The conductive cores are fastened by connecting apparatus. The connecting apparatus comprises a first insulative bracket and a second insulative bracket connected with each other. The end of conductive core is connected to the first insulative bracket and the second insulative bracket and is soldered on the interior PCB. A side of the bottom shell defines a cavity to receive the interior printed circuit board. Another side of the bottom shell defines a groove for receiving the metal ring. The top shell engages with the bottom shell to retain the interior printed circuit board.

The first insulative bracket and the second insulative bracket are used to fasten the conductive core to the interior printed circuit board. The configuration of the first insulative bracket and the second insulative bracket are complex. The production cost of the SFP module is high.

Hence, an improved cable assembly is required to overcome the above-mentioned disadvantages of the related art.

SUMMARY OF THE INVENTION

An object of the present invention is to provide a cable assembly having low costed insulative holding device capable of fastening the cable reliably and having simple structure.

To achieve the aforementioned objects, an cable assembly comprises an interior printed circuit board, a cable and an insulative holding device. The interior printed circuit board comprises a plurality of conductive pads. The cable comprises a plurality of conductors, a conductive sheath shrouding the conductors and an insulative sheath shrouding the conductive sheath. Each conductor has a soldering tail extending to the outside of the insulative sheath and soldering to the conductive pad. An insulative holding device encloses the insulative sheath and the conductors.

The insulative holding device of the cable assembly encloses the insulative sheath and the conductors simultaneously. The structure of insulative holding device is simple. The cost of manufacturing the cable assembly is low.

Other objects, advantages and novel features of the invention will become more apparent from the following detailed description of a preferred embodiment when taken in conjunction with the accompanying drawings.

DETAILED DESCRIPTION OF THE INVENTION

Figure 1:
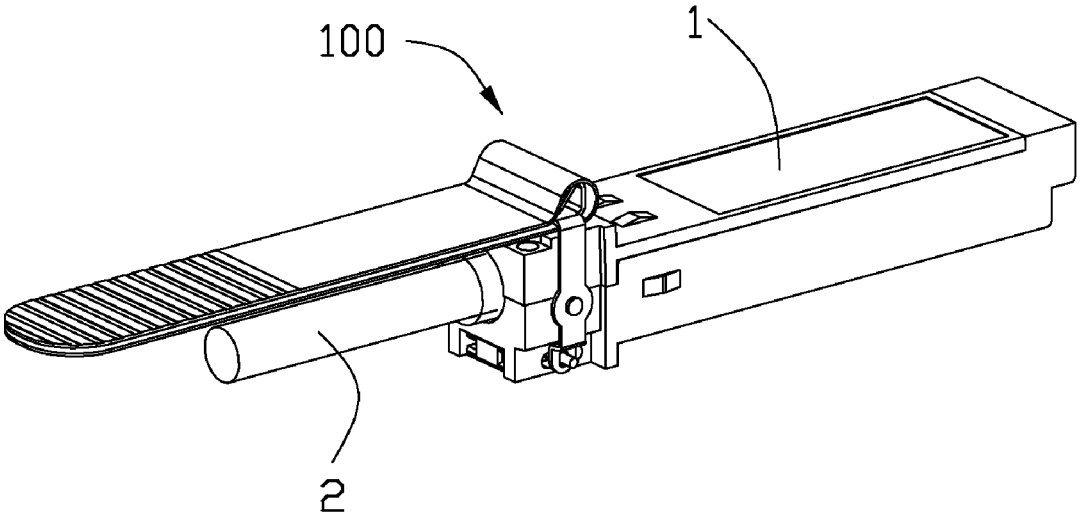
FIG. 1 is an assembled perspective view of a cable assembly in accordance with the present invention.
Figure 2:
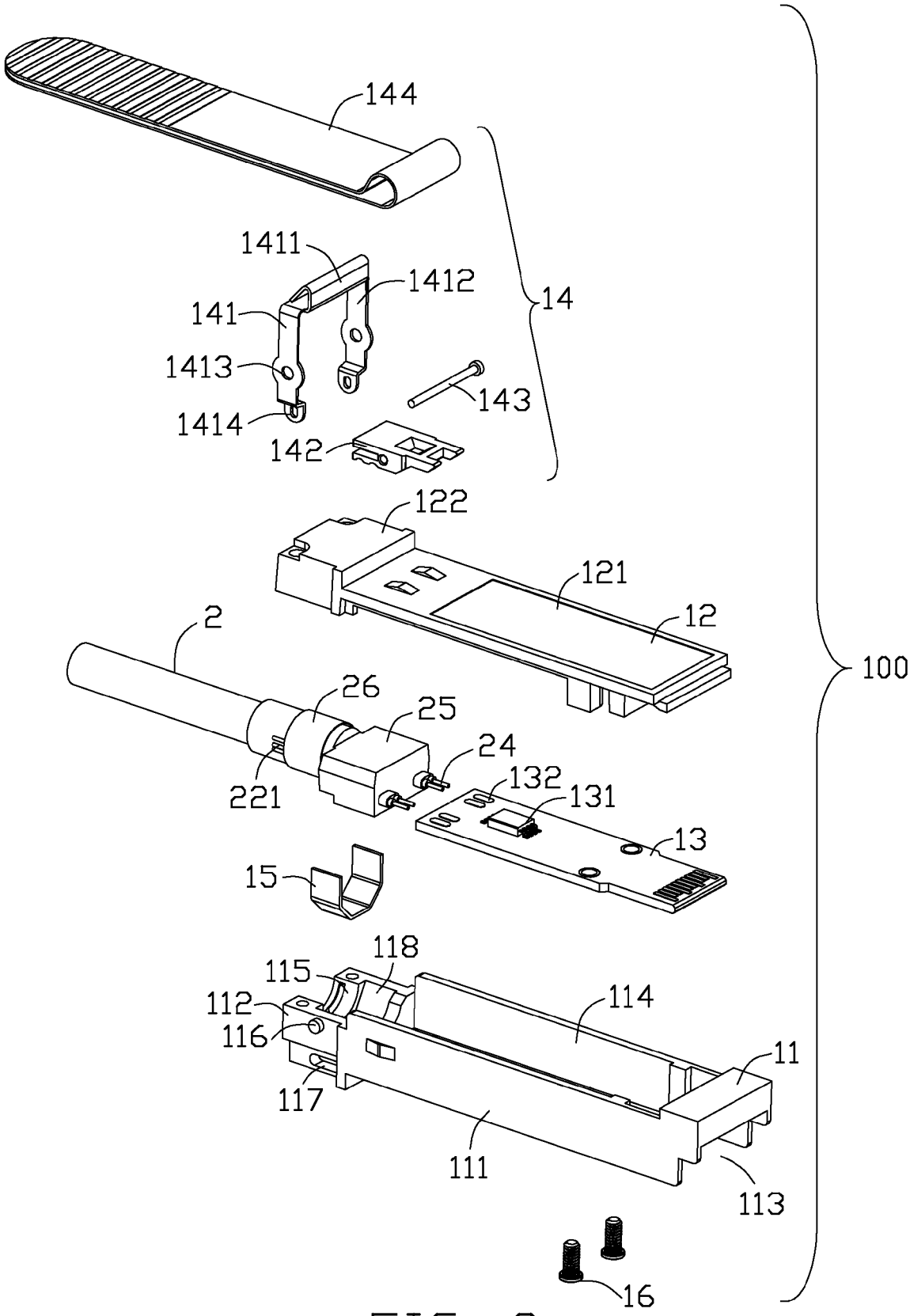
FIG. 2 is an exploded perspective view of the cable assembly as shown in FIG. 1.

Reference will now be made to the drawing figures to describe the present invention in detail. Referring to FIGS. 1-2, a cable assembly 100 according to the present invention is a SFP module. The cable assembly 100 comprises a module 1 and a cable 2 connecting to the module 1.

Referring to FIG. 2, the module 1 comprises a bottom shell 11, a top shell 12 coupling with the bottom shell 11, an interior PCB 13 received in the bottom shell 11, and a releasing device 14. The bottom shell 11 comprises a base portion 111 and a cable-receiving portion 112. The base portion 111 defines a cutout 113 for engaging with a mating connector (not shown) and a first cavity 114 for insertion of the mating connector. The cable-receiving portion 112 defines a half-cylindrical second cavity 115, a pair of cylindrical posts 116 and a slot 117. Part of the second cavity 115 is formed with a recess 118. The top shell 12 comprises a flat portion 121 covering the first cavity 114 and a connection portion 122 defining a half-cylindrical cavity (not shown) corresponding to the second cavity 115.

The interior PCB 13 is received in the first cavity 114. The interior PCB 13 is provided with a plurality of electronic components 131 and a plurality of conductive pads 132 for connecting with the cable 2.

The releasing device 14 comprises a shaft 143, a metal frame 141 privotable about the shaft 143, a slider 142, and a strip 144. The metal frame 141 comprises a first beam 1411, and a pair of second beams 1412 extending from opposite distal end of the first beam 1411. Each second beam 1412 defines a first hole 1413 and a second hole 1414 below the first hole 1413. The cylindrical post 116 is received in the first hole 1413. The shaft 143 inserts through the pair of second holes 1414 of the second beams 1412, a hole of the slider 142 and the slot 117 to fasten the releasing device 14 in the bottom shell 11.

Figure 3:
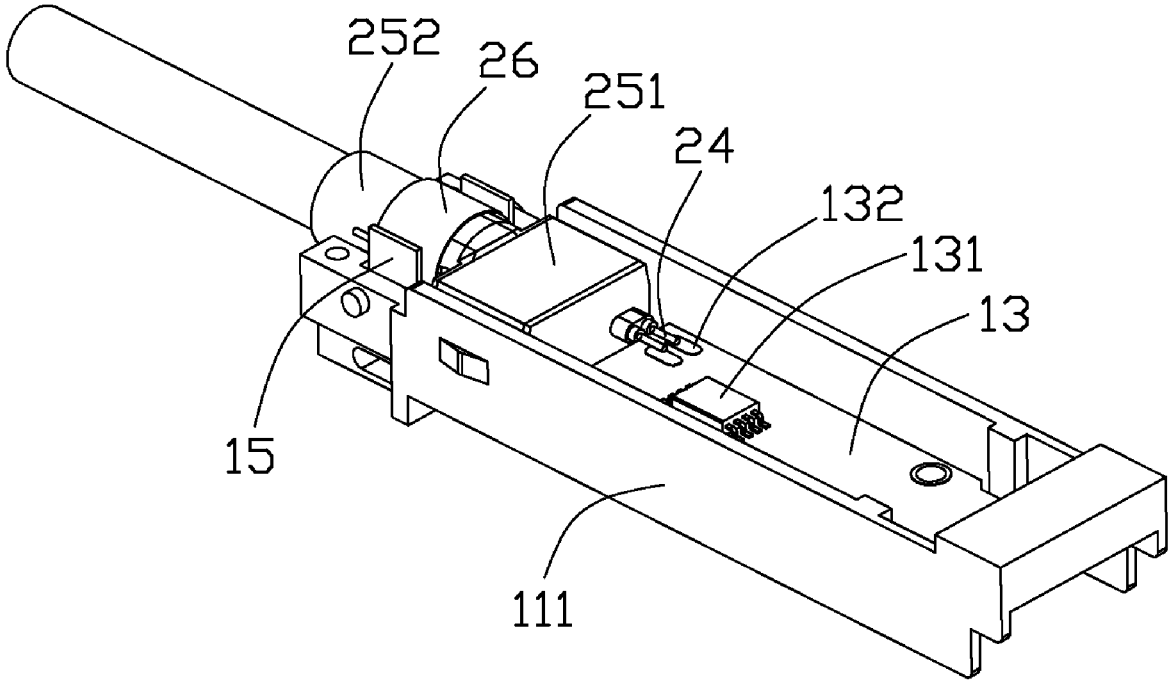
FIG. 3 is partially assembled perspective view of the cable assembly, with a top shell and a releasing device being removed.
Figure 4:
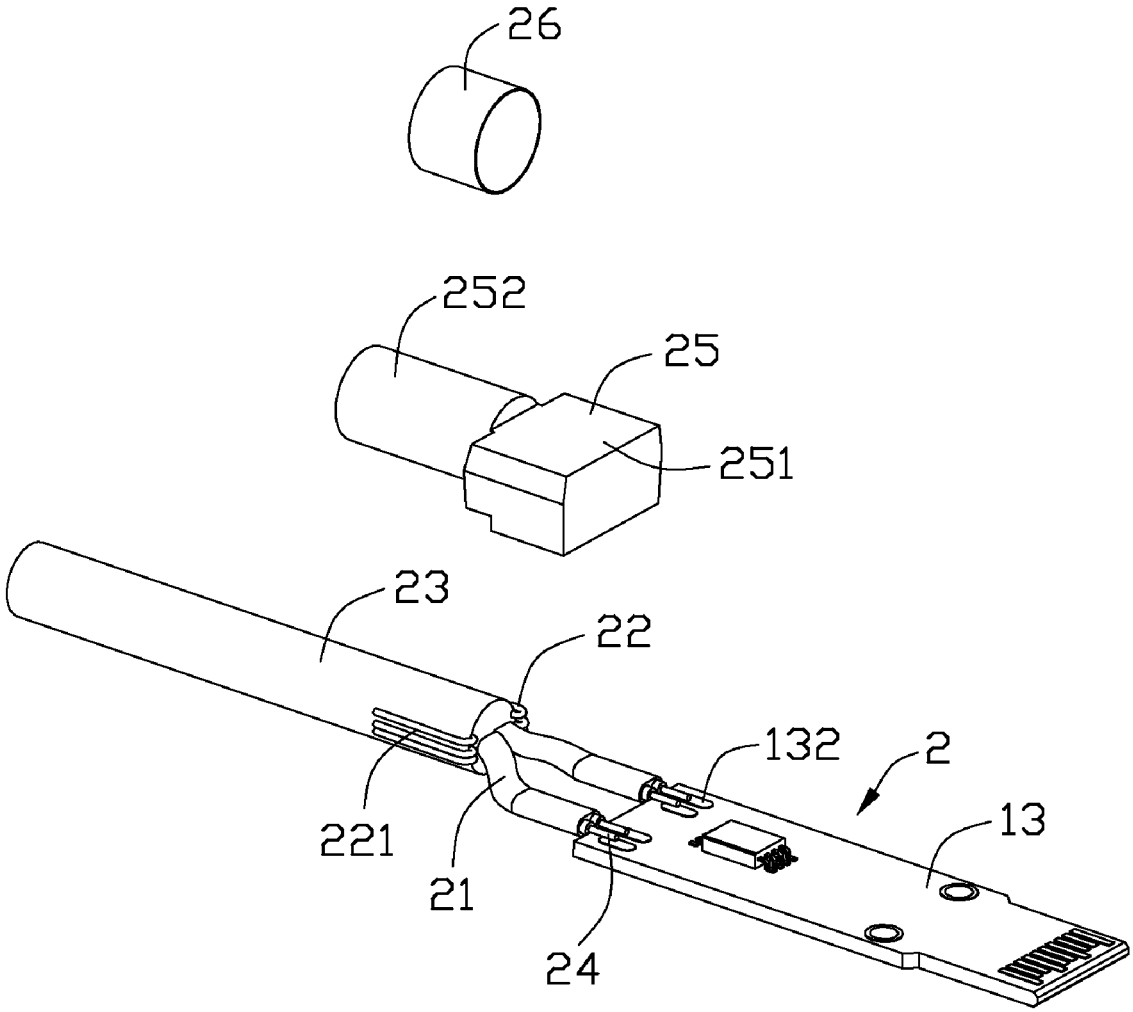
FIG. 4 is an exploded perspective view of the cable, interior printed circuit board, insulative holding device and electronic strip of the cable assembly as shown in FIG. 1.

Referring to FIGS. 2-4, the cable 2 comprises four conductors or inner wires 21, a conductive sheath 22 shrouding the conductors 21, and insulative sheath 23 enclosing the conductive sheath 22. Each conductor 21 comprises a soldering tail 24 extending outside of the insulative sheath 23. The distal end of the soldering tail 24 is soldered to the conductive pad 132 of the interior PCB 13. The cable 2 further comprises an insulative holding device 25 and a conductive strip 26. The insulative holding device 25 comprises a rectangle portion 251 and a columnar portion 252 integrated with each other. The rectangle portion 251 encloses the conductors 21. The columnar portion 252 encloses the insulative sheath 23. The conductive sheath 22 comprises a grounding portion 221 extending to the outside of the insulative holding device 25. The conductive strip 26 encircles around the columnar portion 252 of the insulative holding device 25.

The cable assembly 100 further comprises a conductive semi-circular ring 15. The conductive semi-circular ring 15 is attached to the columnar portion 252 of the insulative holding device 25 to fasten the cable 2 and insulative holding device 25 in the bottom shell 11.

Referring to FIGS. 1-4, in assembling of the cable assembly 100, firstly, dilacerate a segment of the insulative sheath 23 to expose a front portion of the conductive sheath 22 outerside of the insulative sheath 23. The segment of the conductive sheath 22 is formed into a grounding portion 221. Secondly, insert molding the insulative sheath 23 and the conductors 21 with insulative material to form an insulative holding device 25, with the conductive sheath 22 exposed on the outside of the insulative holding device 25. Thirdly, bend the grounding portion 221 backwardly and outwardly of the insulative holding device 25. Fourthly, encircle the conductive strip 26 around the grounding portion 221. Fifthly, solder the conductors 21 on the conductive pads 132. Sixthly, attach the conductive semi-circular ring 15 to the columnar portion 252 of the insulative holding device 25. Then, assemble the cable 2 with interior PCB 13 and insulative holding device 25 in the top shell 12 and bottom shell 11. Lastly, fasten the bottom shell 11 on the top shell 12 with screws (not labeled).

According to the present invention, the columnar portion 252 fastens the soldering tails 24 on the predetermined position for soldering the soldering tail 24 on the interior PCB 13. The rectangle portion 251 is received in the first cavity 114 and the columnar portion 252 is received in the second cavity 115 to connect the cable 2 with the conductive sheath 22 effectively. The structure of insulative holding device 25 is simple. The cost of manufacturing the cable assembly 100 is low.

However, the disclosure is illustrative only, changes may be made in detail, especially in matter of shape, size, and arrangement of parts within the principles of the invention.

What is claimed is:

1. A cable assembly comprising:

a shell defining a front cavity and a rear cavity smaller than said front cavity;

a cable defining a plurality of inner wires, a conductive sheath enclosing said wires, and an insulative sheath enclosing said conductive sheath;

an insulative holding device including integral front rectangular portion and rear round columnar portion overmolded around a front segment of the insulative sheath and with the inner wires fixed in the front rectangular portion;

a front portion of the conductive sheath extending out of the rear round columnar portion of the insulative holding device and extending along a circumference of the insulative holding device axially and backwardly; and a conductive strip wrapping the backwardly extending conductive sheath and along with the rear round columnar portion commonly disposed in the rear cavity, the front rectangular portion being received in the front cavity.

2. The cable assembly as claimed in claim 1, wherein a conductive semi-circular ring encloses the conductive strip in the rear cavity.

* * * * *